United States Patent [19]

Weirich et al.

[11] 4,391,553

[45] Jul. 5, 1983

[54] HYDRAULIC CONTROL SYSTEMS FOR AND METHODS OF CONTROLLING THE OPERATION OF TUNNELLING APPARATUS

[75] Inventors: Walter Weirich, Dortmund; Herbert Heitkamp, Werne, both of Fed. Rep. of Germany

[73] Assignee: Gewerkschaft Eisenhutte Westfalia, Fed. Rep. of Germany

[21] Appl. No.: 281,385

[22] Filed: Jul. 8, 1981

[30] Foreign Application Priority Data

Jul. 9, 1980 [DE] Fed. Rep. of Germany ..... 3025922

[51] Int. Cl.[3] ..... E21D 11/00

[52] U.S. Cl. ..... 405/141; 405/138

[58] Field of Search ..... 405/138–149; 299/31–33

[56] References Cited

U.S. PATENT DOCUMENTS 2,466,709 4/1949 Karr ..... 405/146 X
3,372,553 3/1968 Samoilov et al. ..... 405/141
4,147,453 4/1979 Unger et al. ..... 405/141
4,224,004 9/1980 Heitkamp ..... 405/141 X

FOREIGN PATENT DOCUMENTS 2337131 2/1975 Fed. Rep. of Germany ..... 405/141

*Primary Examiner*—Dennis L. Taylor
*Attorney, Agent, or Firm*—Thompson, Birch, Gauthier & Samuels

[57] ABSTRACT

A hydraulic control system serves to control the operation of hydraulic rams used to position and displace an annular member which delimits a concrete reception space disposed at the rear of a tunnel-driving apparatus. The system acts to compensate for irregular loading on the annular member to ensure the latter is drawn up behind a forward drive shield without twisting or tilting. The rams are divided into groups each connectible to its own pump unit and the system connects the chambers of the rams which reduce in volume as the member is drawn up to the pump units in a manner such that the latter act as brake motors to restrain the member against the concrete pressure differential on its rear side.

18 Claims, 3 Drawing Figures

HYDRAULIC CONTROL SYSTEMS FOR AND METHODS OF CONTROLLING THE OPERATION OF TUNNELLING APPARATUS

BACKGROUND TO THE INVENTION

The present invention relates in general to apparatus for use in driving tunnels, adits, roadways galleries and similar underground excavations referred to hereinafter simply as "tunnels". More particularly the invention relates to a hydraulic control system for, and a method of, controlling hydraulic rams which act on an annular screen member or the like used to delimit a concrete reception space behind a drive shield. As is known, concrete is introduced into the space in situ to create a lining for the tunnel and the annular member is drawn up to follow the progress of the drive shield. The annular member can be drawn up continuously or intermittently depending on the mode of operation. German Patent Specifications Nos. 2550030, 2558670 and 2522029 all described typical prior art apparatus with which the present invention is concerned. The annular screen member or front shuttering is normally connected via rams to the drive or cutter shield or to the frame of the latter. The concrete reception space is also limited at its radial inside and outside by further means. For example, one or more tubular pieces can serve as radial inner shuttering while in the case of apparatus employing a series of elongate drive members to form the drive shield these drive members or cutters can have rear extensions or tails which limit the concrete reception space at the radial exterior. Concrete is pumped into the reception space under pressure and the screen member or front shuttering must be held against this pressure with the aid of its rams. As the driving operation progresses the screen member must be drawn up to permit further concrete to be introduced into the reception space and it is desirable to advance the screen member uniformly to avoid tilting or jamming. This is difficult to achieve in practice because the friction forces on the member are not always uniform and moreover because the concrete pressure is not uniform over the rear side of the member and tends to be greater over the lower region. A general object of the present invention is to provide an improved control system and method which enables these problems to be overcome.

SUMMARY OF THE INVENTION

In accordance with the invention pumping means for supplying hydraulic pressure fluid to the rams used to position the aforementioned screen member or front shuttering or its equivalent comprises a main pump and a plurality of individual auxiliary pump units which can also act as brake motors. The working chambers of the rams are connected with the aid of control valves to associated pump units and/or to the main pump. During advancement of the screen member the system connects the main pump to first working chambers of the rams while the second working chambers of the rams, the volume of which decreases during such advancement, are connected serially with the pump units so that the latter acts as braking means. By operating the pump units in this manner and by allocating one such unit to each of a group of rams the pump units retard the forward displacement of the screen member which can be accomplished by the joint action of the main pump and the pressure in the concrete reception space. These pump units divide the flow of pressure fluid and are also capable of holding the screen member or front shuttering against the concrete pressure. The tendency of the screen member to become jammed or tilted can thus be avoided. The overall system can be used whether the concrete lining is formed continuously or incrementally. When the screen member has been drawn up as described the main pump is disconnected from the first working chambers of the rams and the pump units serve to provide pressure fluid to the second working chambers of the rams to hold the screen member in position and possibly to move the latter slightly to compress the concrete in the reception space. Charging of the first working chambers of the rams with pressure fluid can produce retraction of the rams while charging of the second working chambers with pressure fluid can produce extension of the rams. The cylinders of the rams can then be supported on the drive or cutter shield at the front of the tunneling apparatus or on a support frame thereof while their piston rods are connected to the screen member.

In one embodiment of the invention the rams are arranged in three groups each having a control valve which serves to connect the rams of that group to one of the pump units. The main pump can then be incorporated with one or more further valves in a circuit which by-passes the control valves to link all the rams to the main pump. This arrangement provides a statically-determinate three-point control such as is known for controlling the movements of the support frame of a cutter shield - see German Patent Specification No. 2239565.

The pump units are preferably inherently capable of acting as pumps or brake motors but it is possible to utilize composite means with synchronously-regulated individual brakes or retarders or one common brake retarder which switches into the hydraulic circuit to take over from the pumps in the appropriate mode of operation. In the former case however it is possible to utilize radial piston pump units which take the form of cylinder blocks seated around a common drive shaft. It is possible to then adopt a common drive motor to drive the pump units as well as the main pump. In certain circumstances however it may be preferred to provide separate individual drives for the main pump and the pump units. The latter arrangement is advisable in cases where the concrete pressure is itself sufficiently great to displace the screen member on its own. The pump units would then reverse their function to act as brake motors and their drive motor or motors would function as a generator. The ratio between the delivery volume of the main pump and the intake volume of the pump units can be chosen to be at least slightly less than the ratio between the cross-sectional areas of the working chambers of the rams. The main pump preferably then has a delivery volume somewhat in excess of the pump units and preferably this delivery is adjustable.

In further developments of the invention the control valves associated with the individual pump units and the groups of rams can be supplemented by further shift valves in parallel with the control valves which operate to connect the inlets of the pump units with the second working chambers of the rams during drawing up of the screen member. Another switching or change over valve then preferably serves to connect the main pump to the first working chambers of the rams in this operational sequence. The switching valve and the shift valves can be operated in unison or common, for example, electromagnetically. The control valves preferably have three states one where the associated pump unit is connected to the first working chambers of the associated ram group, a second where the associated pump unit is connected to the second working chambers of the associated ram group and a third where the chambers are blocked or isolated from the pump units. Preferably in this third state the outlets of the pump units are connected to the pressure fluid return path. The system can also employ pressure relief valves to prevent excess pressure in any of the conduits or devices pertaining to the system.

In accordance with another aspect of the invention there is provided an improved method of controlling the operation of the rams used to move and position the annular screen member or its equivalent. This method comprises connecting the first working chambers of all the rams to a pump to charge said working chambers with pressure fluid and connecting the second working chambers of groups of the rams to respective fluid braking means.

The invention may be understood more readily and various other aspects and features of the invention may become apparent from consideration of the following description.

BRIEF DESCRIPTION OF DRAWINGS

An embodiment of the invention will now be described by way of example only, with reference to the accompanying drawings, wherein.

DESCRIPTION OF PREFERRED EMBODIMENT

Figure 1:
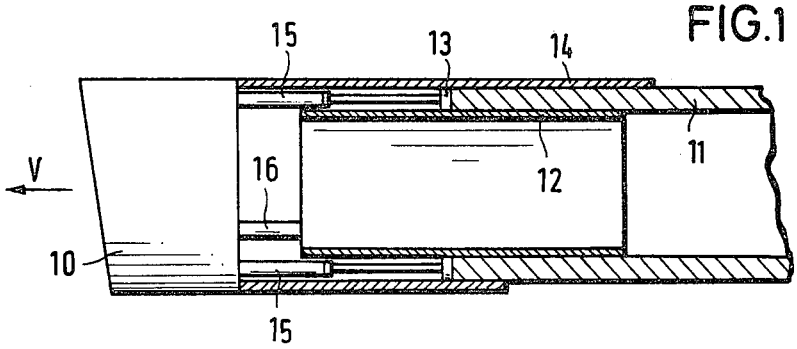
FIG. 1 is a diagrammatic part-sectional side view of tunnel driving apparatus.

FIG. 1 depicts in simplified form apparatus for use in driving a tunnel or similar excavation. The apparatus employs a main front drive shield 10 which is advanced in the direction of arrow V with the aid of hydraulic rams. The shield 10 can be a continuous structure or a cutter shield composed of a series of elongate drive members or cutters arranged side-by-side and supported for individual displacement on a frame. In the latter case the rams would be used to advance the drive members individually or in groups depending on the particular construction adopted. As the shield 10 is advanced by means of the rams a lining 11 is created at the rear of the tunnel. As is known, the lining 11 is produced in situ with the aid of flowable concrete introduced under pressure. A tubular member or inner shuttering 12 serves to limit the space which receives the concrete radially inwardly and supports the concrete until the latter itself becomes self-supporting. An annular screen member 13 closes off the concrete reception space from the front end and acts as front shuttering. The space is also limited radially outwardly by the provision of a rear shield 14. This rear shield 14 also supports the tunnel wall over the region where the concrete is introduced. As is known, the rear shield 14 can be formed by rear extensions or tails of the drive members of the front shield 10 where the latter is of this type. The member 13 is slidably guided on the rear shield 14 and the inner shuttering 12. The member 13 is connected via double-acting hydraulic rams 15 with the drive shield 10, and where the latter is composed of individual drive members, the rams 15 would connect with the frame thereof. As the shield 10 advances in the course of the driving work, the member 13 can be drawn up with the aid of the rams 15 either continuously or intermittently. The tubular member or inner shuttering 12 can likewise be connected with the shield 10 or its frame with the aid of additional double-acting hydraulic rams 16 which enables this component to be drawn up to follow the progress as well. It is however possible to utilize transferable or transposable means, such as a series of tubular members arranged end-to-end to constitute the inner shuttering 12 and in this case the rams 16 are omitted and there is then no connection established between the shuttering 12 and the shield 10. During operation, it is desirable to produce the lining 11 progressively in accordance with the driving progress and as the member 13 is drawn up with the rams 15 concrete is pumped into the reception space continuously or intermittently. In the latter case the member 13 is advanced in incremental stages, each corresponding to the length of one concrete section, once the preceding concrete section has become self-supporting. This means that its member 13 must be held in a stationary position for some time until the corresponding concrete section has been created.

Figure 2:
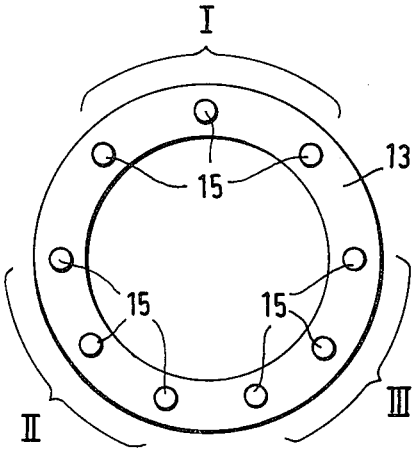
FIG. 2 is a schematic end view of an array of rams used in the apparatus shown in FIG. 1.
Figure 3:
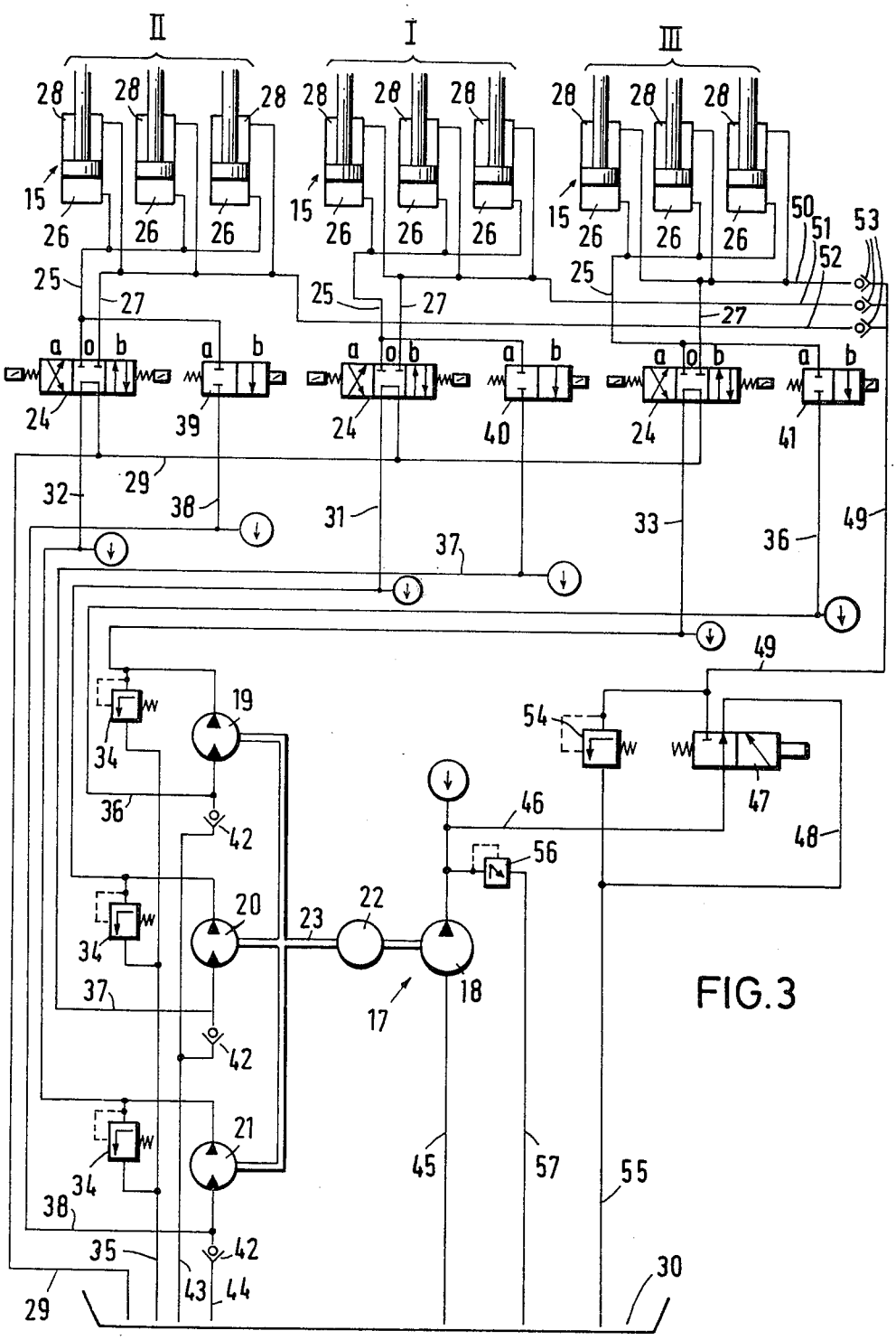
FIG. 3 is a schematic diagram depicting a control system for controlling the operation of the rams of the apparatus.

FIG. 2 depicts, by way of example, an array of some nine rams 15 equispaced around the member 13. The rams 15 are divided into three groups, I, II and III for hydraulic control purposes. The hydraulic pressure fluid for operating the rams 15 is provided by a control system which serves to draw up the member 13 evenly and independently of the frictional forces and concrete pressure to avoid twisting or tilting. FIG. 3 depicts a suitable control system designed to achieve this objective.

As shown in FIG. 3, the control system has pumping means 17 which draws pressure fluid from a reservoir 30. The pump means 17 comprise a main pressure pump 18 and three subsidiary pump units 19,20, 21 all driven by a common electric motor 22. Conveniently the pump units 19,20 and 21 are arranged on a common pump shaft 23 and preferably take the form of radial piston pumps. In such a construction, known per se, the units 19, 20 and 21 are embodied as cylinder blocks arranged axially one behind another on the common shaft 23. Each unit 19, 20 and 21 then comprises a plurality of piston and cylinders delivering pressure fluid into a common pressure fluid conduit. The pump units 19, 20 and 21 all provide the same delivery quantity of fluid per unit time and this quantity is less than that provided by the main pump 18.

Each group of rams 15 designated I, II and III is associated with a control valve 24. Each valve 24 has a port connected via a conduit 25 with working chambers 26 of the rams 15 of the associated groups I, II, III and another port connected via a conduit 27 with the other working chambers 28 of the rams 15 of the associated group I, II,III. The valves 24 have further ports connected to a common return conduit 29 leading back to the pressure fluid reservoir 30 for the pumping means 17. The valves 24 also have ports connected via conduits 31, 32, 33 to the outlets of the respective pump units 20, 21 and 19. The outlet of each pump unit 19, 20, 21 is also connected to a pressure relief valve 34 and these valves 34, which open at a predetermined excess pressure level, connect with a common conduit 35 leading back to the reservoir 30. The pressure of the fluid in the conduits 31, 32, 33 is thus limited by the presence of the relief valves 34. The inlets to the pump units 19, 20, 21 are connected via non-return valves 42 and conduits 43, 44 to the reservoir 30 so as to draw pressure fluid therefrom. The inlets to the pump units 19, 20, 21 are also connected via conduits 36, 37, 38, respectively to "on off" shift valves 39, 40, 41 respectively. The valves 39, 40, 41 connect with the conduits 25 leading to the chambers 26 of the rams 15 of the associated groups I, II, III and normally adopt the blocked state a.

The main pump 18 has its inlet connected via a conduit 45 to the reservoir 30 to draw in pressure fluid. The outlet from the pump 18 is connected via a conduit 46 to the inlet port of a change-over valve 47. This valve 47 has one outlet port connected via conduits 48, 55 back to the reservoir 30 and another outlet port connected via a common conduit 49 and individual conduits 50,51,52 to the working chambers 28 of the rams 15 of the respective groups III, II, I. Non-return valves 53 are provided in the conduits 50, 51, 52. The conduit 49 is also connected through a pressure-relief valve 54 to the conduit 55 leading to the reservoir 30. In addition another pressure relief-valve 56 is connected from the outlet of the pump unit 18 to the reservoir 30 via a conduit 57. Excess pressure in the conduits 50, 51, 52 is prevented.

The control valves 24 can be manually or automatically operated locally or remotely. In the operating state o of the valves 24, as illustrated, the chambers 26, 28 of the rams 15 of the associated groups I, II, III are isolated or blocked and the conduits 31, 32, 33 are connected to the return conduit 29 to connect the outlets from the pump units 19, 20, 21 back to the reservoir. In the operating state a of the valves 24 the chambers 28 of the rams 15 of the associated group I, II, III are connected to the outlet of the associated pump unit 19, 20, 21 while the chambers 26 are connected to the return conduit 29. With the valves 24 in this state a, the rams 15 therefore retract. In the operating state b of the valves 24, the chambers 26 of the rams 15 of the associated group I, II, III are connected to the outlet of the associated pump unit 19, 20, 21 while the chambers 28 are connected to the return conduit 29. With the valves 24 in the state b the rams 15 therefore extend. The valves 39 are normally biased to adopt the blocked state o as illustrated in the drawing. It can be arranged that the retraction of the rams 15 (state a of the valve 24) causes the advancement of the member 13 in the forward direction V while conversely the extension of the rams 15 (state b of the valves 24) causes the member 13 to be held against the pressure of the concrete in the reception space or perhaps moved slightly in the rearward direction to compress the concrete. When the member 13 is to be advanced in the direction of the arrow V, and especially in the case of continuous concreting, the main pump 18 is used to supply pressure fluid to the chambers 28 of the rams 15 and this is accomplished by operating the valves 47,39,40,41. In the position or state illustrated the valve 27 connects the conduit 46 back to the return conduits 55, 48 but by changing the state of the valve 47, manually or automatically, the conduit 46 is connected to the conduit 49 and thence via the conduits 50, 51, 52 to the chambers 28. When the valve 47 changes state to charge the chambers 28 with pressure fluid to advance the member 13, the valves 39 to 41 are also set to state b to establish direct communication between the chambers 26 and the inlet to the pump units 19, 20, 21. The valves 24 adopt the blocked state o. The pump units 19 to 21 now act as retarder or brake motors in respect of the groups I, II, III to control and regulate the fluid flow. This ensures that all the rams 15 retract uniformly independently of the frictional load on the member 13. In practice, the concrete pressure tends to be greater in the lower region of the reception space corresponding to the position of the groups II and III in FIG. 2. The rams 15 of these groups would be automatically braked more strongly when the member 13 is being advanced to compensate for this pressure differential. If the pressure is so large in the lower region of the concrete reception space that the resultant force exerted on the member 13 is greater than that applied by the rams 15 in the upper group I it is advisable to drive the pump 18 with a separate motor rather than to use a common motor 22 as depicted in FIG. 3. Then, the or each motor used to drive the pump units 19, 20 and 21 will function as a generator while these pump units 19, 20 and 21 operate as brake motors. Once the member 13 has been drawn up in this controlled manner the valves 47, 39, 40 and 41 would be re-set to the former state to permit the valves 24 alone to be used to position the member 13.

The division of the rams 15 into three control groups I, II and III and the above-described hydraulic control system provides a statically-determinate arrangement. Even when the pump units 19 to 21 become worn to a different extent and provide different delivery and intake volumes reliable displacement of the member 13 is still possible. It is also possible to move the member 13 by only operating some of the rams 15 and, for example, the pump 18 can be selectively connected to at least two of the rams 15 to advance the member 13. Means can be provided to regulate the quality of pressure fluid delivery by the pump 18 for enhanced control.

We claim:

1. In or for tunnelling apparatus which employs a drive shield, a concrete-reception space defined rearwardly of the drive shield to receive concrete, during use, to produce a lining for the tunnel, the space being delimited at the front end by an annular member and double-acting hydraulic rams with first and second working chambers usable to position the annular member; an improved control system for controlling the operation of the rams, said system comprising pumping means for providing hydraulic pressure fluid for charging the working chambers of rams, said pumping means at least including a plurality of individual pump units and a main pump and means for selectively connecting the respective working chambers of the rams to the pump units and to the main pump, wherein the first working chamber of each ram receives pressure fluid from the main pump when the connecting means is set to make the annular member move up towards the drive shield and the second working chamber of said ram, which tends to decrease in volume when the connecting means is thus set, is connected to a respective one of the pump units which then functions as a brake motor.

2. A system according to claim 1, wherein the rams are operationally divided into groups, each group being associated with a respective one of the pump units and the connecting means includes control valves, each serving to selectively connect the working chambers of the rams of an associated group to the associated pump unit.

3. A system according to claim 2, wherein each control valve has three operating states, a first state, for connecting the first working chambers of the associated group of rams to the outlet of the associated pump unit, and the second working chambers of the associated group of rams to a pressure fluid return path, a second state for connecting the second working chambers of the associated group of rams to the outlet of the associated pump unit and the first working chambers of the associated group of rams to the pressure fluid return path and a third state for isolating the working chambers of the associated group of rams from the pump unit and return path.

4. A system according to claim 3, wherein further valves are provided one for each control valve, each further valve having an operating state which by-passes the control valve and connects the second working chamber of the associated group of rams to the inlet of the associated pump unit when the main pump is connected to the first working chambers thereof.

5. A system according to claim 4, wherein another valve is provided for connecting the main pump to the first working chambers of all the rams.

6. A system according to claim 1, wherein a common braking means is associated with all the pump units.

7. A system according to claim 1, wherein each pump unit is associated individually with a synchronously-regulated braking means.

8. A system according to claim 1, wherein a common drive motor serves to drive all the pump units.

9. A system according to claim 1, wherein a common drive motor serves to drive all the pump units and the main pump.

10. A system according to claim 1, wherein synchronously-regulated individual drive motors serve to drive the pump units.

11. A system according to claim 1, wherein the pump units are in the form of radial piston pumps.

12. A system according to claim 5, wherein the further valves and said other valve are actuable in common.

13. A system according to claim 1, wherein the ratio between the delivery volume of pressure fluid from the main pump and the intake volume of pressure fluid to the pump units is less than the ratio between the cross-sectional areas of the working chambers of each of the rams.

14. A system according to claim 1, wherein a pressure-relief valve is provided between the outlet from the main pump and a pressure fluid return path.

15. A system according to claim 3, wherein the third state of each control valve also connects the outlet of the associated pump unit to the return path.

16. A system according to claim 1, wherein a pressure-relief valve is connected between the outlet of each of the pump units and a pressure fluid return path.

17. In tunnelling apparatus which employs a drive shield, a concrete-reception space defined rearwardly of the drive shield to receive concrete, during use, to produce a lining for the tunnel, the space being delimited at the front end by an annular member and double-acting hydraulic rams with first and second working chambers usable to position the annular member; an improved method of controlling the operation of the rams to move the annular member towards the drive shield which method comprises connecting the first working chambers of all the rams to a pump to charge said working chambers with pressure fluid and connecting the second working chambers of groups of the rams to respective fluid braking means.

18. A method according to claim 17 and further comprising connecting the second working chambers of said groups of rams to respective auxiliary pump units which function as brake motors.

* * * * *